United States Patent [19]

Mahieu

[11] Patent Number: 4,629,188

[45] Date of Patent: Dec. 16, 1986

[54] BASEBALL PITCHING TARGET WITH AN ADJUSTABLE STRIKE ZONE

[76] Inventor: Peter A. Mahieu, Box 186, Williamsburg, Mass. 01096

[21] Appl. No.: 588,061

[22] Filed: Mar. 9, 1984

[51] Int. Cl.[4] ..... A63D 69/40

[52] U.S. Cl. ..... 273/26 A; 273/407

[58] Field of Search ..... 273/26 A, 181 F, 176 K, 273/407, 409

[56] References Cited

U.S. PATENT DOCUMENTS

| | | | |
|---|---|---|---|
| 1,507,343 | 9/1924 | Degenhardt | 273/26 A |
| 1,511,430 | 10/1924 | Schonberg | 273/26 A |
| 3,583,703 | 6/1971 | Brown | 273/26 A |
| 4,153,246 | 5/1979 | Byrne | 273/26 A |
| 4,295,648 | 10/1981 | Stromback | 273/26 A |

*Primary Examiner*—Richard C. Pinkham
*Assistant Examiner*—T. Brown

[57] ABSTRACT

A baseball target device is disclosed wherein the device includes a target that is adjustable in height and length to simulate the strike zones of different size batters. In the preferred embodiment, the device utilizes a base to which a telescopically adjustable vertical frame is attached, wherein the frame supports an. adjustable spring-loaded window shade device. The shade of this device hangs down from the frame and its unrolled portion defines a "strike zone" for the pitcher. A picture of a crouched catcher and umpire is imprinted on the shade to give the target a realistic effect. The pitcher may adjust the target to the size of the strike zone for a particular batter by adjusting the telescopic frame to the height of the batter's shoulder and then adjusting the target shade to the batter's knee, thus creating a target whose size and location simulates the exact strike zone for that particular batter.

9 Claims, 6 Drawing Figures

BASEBALL PITCHING TARGET WITH AN ADJUSTABLE STRIKE ZONE

BACKGROUND OF THE INVENTION

This patent relates to baseball pitching targets and more particularly to a device having a variable strike zone at which a pitcher may throw balls.

Baseball pitching targets are usually employed to develop and improve pitching control and accuracy. They can be used by a single player to practice his throwing. Or, they can be used as a backstop so that a batter and pitcher can play a game between them.

As found in baseball, the term "strike zone" is defined as the vertical rectangular area through which a pitcher must throw a baseball to register a strike. The dimensions of this rectangular area are a given width and an adjustable height normally defined by the distance between the knees and the shoulders or armpits of the baseball player at bat. The height and location of the strike zone will thus vary according to a particular batter's height and batting stance.

The game of baseball is an exacting one and, in fact, is often called a "game of inches". Therefore, if a target is used to teach the art of precisely locating one's pitches, it must be capable of duplicating the different strike zones for all the various size batters that a pitcher may face.

Heretofore, practice devices for defining a strike zone or receiving area of a pitched ball have generally been rigid structures with a rectangular opening. The rectangular openings define the strike zone and are usually not realistic because they cannot be adjusted to simulate the correct size and location of the strike zone for individual batters.

There are some prior pitching targets that permit limited, and therefore imprecise, adjustment of their strike zones. For example, the device shown in U.S. Pat. No. 3,752,476 to Mahoney has a fixed size strike zone that can be raised or lowered to a new batter's height. Since the strike zones of two different size batters vary not only in their height but also in their overall length, this prior device cannot accurately simulate the strike zones for all the batters a pitcher may normally face.

While the fixed size target in Mahoney can be raised or lowered to start at the top or bottom of a batter's actual strike zone, its overall length cannot be changed. Consequently, the target's "simulated" strike zone will be either too long or too short for most batters.

Unless both the size and location of a target's strike zone can be varied to perfectly fit different batters, both the pitcher and batters will learn improperly. The pitcher will not learn the varying limits of the strike zone for different batters, and a particular batter will not learn his own limits.

Acccordingly, it is a primary object of the present invention to provide a novel baseball pitching target having an adjustable strike zone that is variable in size and location to realistically represent the strike zone for a particular size batter.

It is another object to provide an improved baseball target device which is inexpensive to manufacture, yet durable and safe to use. Further, the device can be easily assembled by a user without special tools and, after assembly, can be readily adjusted to vary the size and location of its strike zone.

The above and other objects and advantages of this invention will become more readily apparent when the following description is read in conjunction with the accompanying drawings.

BRIEF DESCRIPTION OF THE DRAWINGS

With the foregoing background and objects of the invention in mind, reference is made to the accompanying drawings, in which.

DETAILED DESCRIPTION OF THE PREFERRED EMBODIMENT

Figure 5:
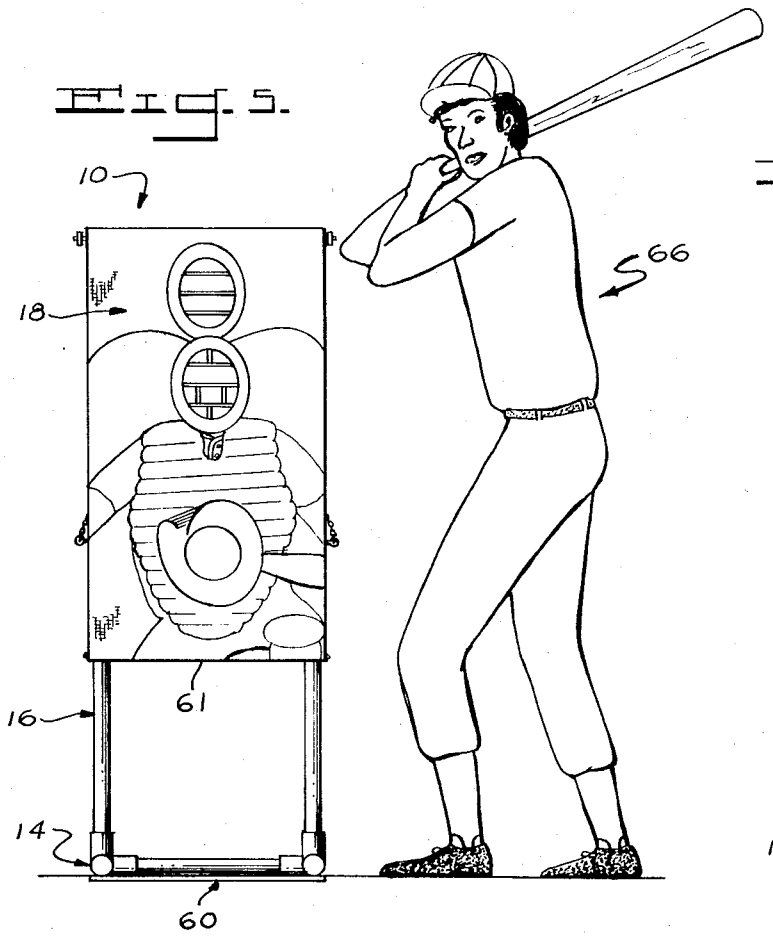
FIG. 5 is a front plan view of the FIG. 1 device with the strike zone adjusted substantially to its maximum height for a tall batter; and, FIG. 6 is a front plan view of FIG. 1 with the strike zone adjusted to a short batter.

Referring to the drawings in detail, a baseball practice or game device with an adjustable strike zone is illustrated and generally designated by the reference numeral 10. The preferred device 10 basically comprises a tubular frame 12 having a horizontal base 14; a generally rectangular support 16 that extends vertically from the base; and, a variable-length pitcher's target 18 that is attached to an upper portion of the support by a roller mechanism 19. As best shown in FIG. 5, the top of the target 18 defines the upper limits of a batter's strike zone while the bottom of the target defines the lower limits of the strike zone. With this device, the vertical support 16 can be adjusted in height to vary the top of a batter's strike zone, while the target can be extended or retracted on the mechanism 19 to vary both the location and the total length of the strike zone to fit the particular batter.

Figures 1, 2, 3:
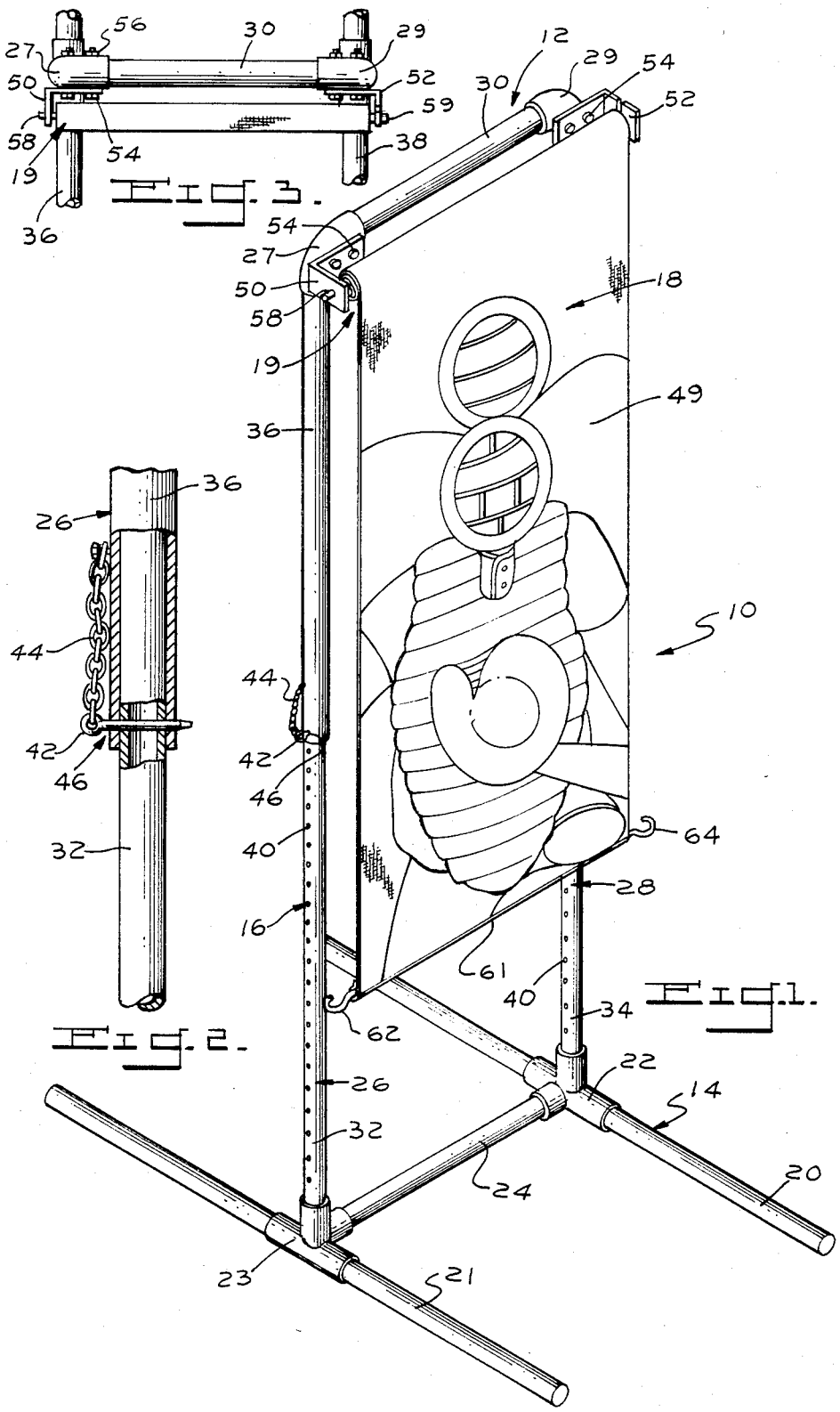
FIG.1 is a perspective view of a baseball pitching target, with an adjustable strike zone, that is constructed in accordance with the present invention.
FIG. 2 is an enlarged fragmentary view, partly in cross section, showing a telescopic portion of a vertically adjustable frame for the FIG. 1 device.
FIG. 3 is a top plan view of the device showing the attachment of a target roller to the frame.

As best shown in FIG. 1, the horizontal base 14 includes two parallel plastic tubes 20, 21. They are connected at their midpoint, by means of modified T-connectors 22, 23 to a third metal tube 24 which is perpendicular to both parallel tubes, thus forming an H-shaped base 14. This base 14 provides the support for the vertical portion 16 of the frame 12, which in turn supports the pitcher's target 18.

The adjustable vertical portion 16 consists of two sets of parallel telescoping tubes 26, 28 connected at their tops by standard elbow connectors 27, 29 to a horizontal cross member 30. This cross member braces the tubes and also acts as the mounting point for the pitcher's target 18.

Lower members 32, 34 of the telescoping tubes 26, 28 are fastened into the modified T-connectors 22, 23 of the base 14 to provide support for the vertical portion of the frame 12. These lower members are plastic tubes of slightly smaller outside diameter than the inside diameter of the upper members 36, 38 of the vertical frame 16 to allow the lower members 32, 34 to slide smoothly, but snugly, inside the upper members 36, 38.

As best shown in FIGS. 1 and 2, each lower vertical member 32, 34 has holes 40 through it, uniformly spaced along its length, to allow adjustment by means of a bolt 42 and chain 44 device placed through a set of holes 46 in the lower portion of its upper vertical members (36 or 38). By removing the bolts 42 from the holes, the upper vertical members 36, 38 may be raised or lowered over the lower vertical members 32, 34 to adjust the top of the frame 30 to a batter's shoulder height. The bolts 42 are then inserted back into the holes 46 and through newly registered holes 40 in the lower members 32, 34 to fix the new frame height and set the top of the device's strike zone for that particular batter.

In the preferred embodiment, the roller mechanism 19 and pitcher's target 18 are a standard window shade set whose shade or sheet 49 has been laminated with the partial figures of a crouched catcher and umpire.

Figure 4:
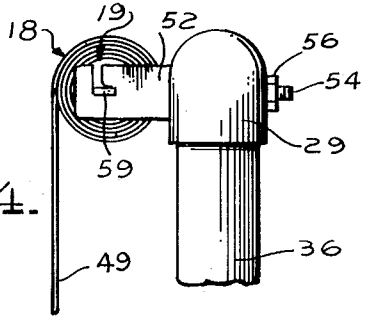
FIG. 4 is a side elevational view of the top portion of the device showing the target roller in position on the adjustable frame.

The preferred roller machanism 19 is mounted flush with the top of frame 12 by two standard, L-shaped window shade holders 50, 52 that are fastened to the elbow connectors 27, 29 by bolts 54 and nuts 56 (see FIG. 3 and FIG. 4). One L-shaped holder 50 has a round hole in it to act as a bearing for a rotating pin or trunnion 58 of the roller for mechanism 19. The other L-shaped holder 52 has a rectangular L-shaped slot to hold a stationary end 59 of the spring section for mechanism 19.

As best shown in FIGS. 1 and 4–6, the preferred target sheet or shade 49 is substantially rectangular and has a constant width substantially equal to that of any batter's strike zone, i.e., the width of a standard home plate 60. One end of the sheet is fixedly attached to the roller so that a midsection of the sheet is adapted to be rollable or unrollable on the roller and a second, free end 61 or bottom edge of the sheet is adapted to hang from it, whereby the unrolled portion of the sheet between the top of the roller and the sheet's bottom edge defines the length of the device's simulated strike zone. Further, the exposed amount of the catcher-and-umpire picture on the unrolled portion presents a realistic strike zone at which a pitcher can take aim.

Once the adjustable frame 12 has been vertically adjusted to fix the top of the target 18 at the shoulder height of a particular batter, the spring-loaded roller mechanism 19 allows the bottom edge 61 of the target to be raised or lowered to that batter's knee. This simultaneously adjusts the overall length and location of the device's simulated strike zone to virtually duplicate the actual strike zone for that batter.

Figure 6:
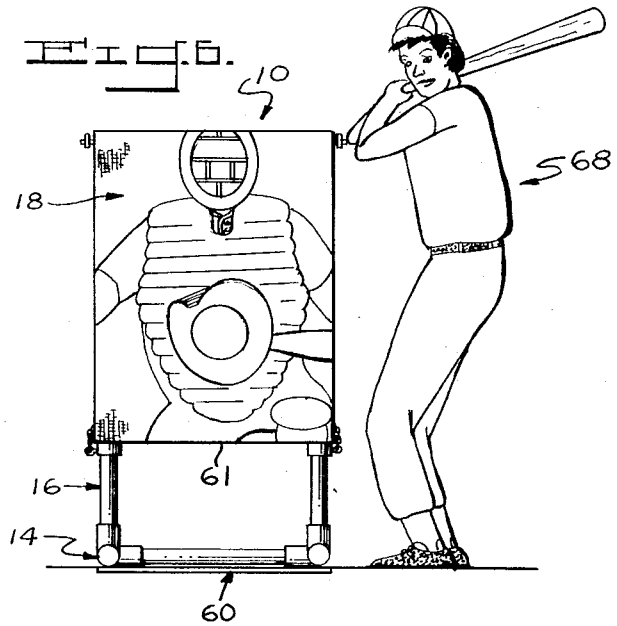

It is important to note that the device 10 allows not only the size of the strike zone to be varied but also the location of the strike zone to be varied to fit a particular batter's height, as illustrated in FIG. 5 and FIG. 6. For adjusting the device from its FIG. 5. position (in which case a tall batter 66 is shown) to its FIG. 6 position (in which a shorter batter 68 is shown), not only is the height of the target 18 varied, but, in addition, its overall length is changed. The length of the target is changed to fit the shorter batter 68 by rolling up the target sheet slightly on mechanism 19 so that the exposed portion of the sheet is less than that shown in FIG. 5. Even though the length of the target is varied, its lower end 61 is still used to define the bottom of the new batter's strike zone and is moved to his knees.

Since the width of the preferred target sheet 49 is equal to that of home plate 60, once the height and length of the target are properly adjusted to fit the size of the particular batter, the device 10 provides a relatively faultless umpire. If a pitcher hits the target with a pitch, it is a strike. If the pitch sails by, it is a ball. The only time for true argument would be if the exposed plastic portions of frame 12 were hit.

Accordingly, the device 10 provides an excellent tool for both pitchers and batters. For pitchers, it teaches them to visualize different strike zones, to position their pitches in particular locations and to pitch under game conditions to different size batters. For batters, it teaches them to learn the specific dimensions of their own strike zones, to adjust to different pitches and to improve swing consistency.

In the preferred embodiment, the lower end 61 of the target sheet 49 includes a pair of hooks 62, 64 to removably fix the lower end to the frame and thereby prevent the target sheet from inadvertently rerolling when a pitch hits it. As best shown in FIG. 1, the hooks are attached to opposite sides of the sheet by any suitable means such as an elastic cord (not shown) that fits through a hem along the bottom of the sheet and has the hooks attached to both of its ends. After the target has been adjusted to fit the particular batter, the free ends of the hooks 62, 64 are wrapped around the frames vertical members 26, 28 and removably placed in adjacent holes 40.

It should be understood by those skilled in the art that the device 10 is intended to be played with a soft or plastic ball, such as a WHIFFLEBALL ® or a sponge ball. A hard ball would not be appropriate because it could crash through the target.

It should also be understood that obvious structural modifications, such as using different materials or a different method to connect parts of the frame, can be made without departing from the spirit or scope of the invention. Accordingly, reference should be made primarily to the accompanying claims rather than the foregoing specification to determine the scope of the invention.

Having thus described the invention, what is claimed is:

1. A baseball target device comprising:

a. a base:

b. a tubular frame extending substantially vertically therefrom;

c. said frame having a spring-loaded roller mechanism mounted across it in a substantially horizontal position, whereby the top of the roller defines the top level of a simulated strike zone for the device;

d. said frame having a pair of telescopic vertical legs whose overall length can be adjusted to raise or lower the height of the roller to conform to the actual top level of a particular batter's strike zone; and, e. a target sheet attached to the roller for simulating the strike zone, said sheet having a width equal to that of any batter's strike zone, said sheet also having one end fixedly attached to the roller so that a midsection of the sheet is rollable upon the roller and a second, free end of the sheet is adapted to hang from it, whereby the unrolled portion of the sheet between the top of the roller and the sheet's free end defines the length of the simulated strike zone, the free end defines the lower level of the device's strike zone and the length of the simulated zone can be selectively varied by rolling or unrolling the sheet from the roller to simultaneously adjust both the length of the device's strike zone and its lower level to conform to the actual length and lower level of the batter's strike zone.

2. The device of claim 1 wherein the target sheet has a picture imprinted on it of a crouched catcher and umpire.

3. The device of claim 1 wherein the target sheet has securing means near its free end for removably attaching the sheet to the frame to prevent the sheet from accidentally rerolling upon the spring-loaded roller when the sheet is hit by a pitched ball.

4. The device of claim 1 wherein the target is rectangular and has a substantially constant width equal to that of a standard home plate used in baseball.

5. A baseball target with an adjustable strike zone, said device comprising:

a. a base;

b. a tubular frame extending substantially vertically from the base, said frame having a spring-loaded roller mechanism attached to it that defines the upper limit of a simulated strike zone for the device, wherein said frame also has telescopic means for vertically adjusting the height of the roller mechanism to the shoulder level of a particular batter;

c. a target sheet attached to the roller for simulating the strike zone, said sheet having one end fixedly attached to the roller so that a midsection of the sheet is rollable upon the roller and a second, free end of the sheet is adapted to hang from it, whereby the unrolled portion of the sheet between the top of the roller and the sheet's free end defines the length of the lower level of the device's strike zone and the length of the simulated zone can be selectively varied by rolling or unrolling the sheet from the roller to simultaneously adjust both the length of the device's strike zone and its lower level to conform to the actual length and lower level of the batter's strike zone.

6. The adjustable device of claim 5 wherein the target sheet is rectangular and has a constant width corresponding to that of a baseball batter's strike zone.

7. The adjustable device of claim 5 wherein the target sheet has the picture of a crouched catcher and umpire on it and the amount of the picture shown to a batter varies with the amount of the sheet that is unrolled from the roller mechanism.

8. The adjustable device of claim 7 wherein the target sheet has securing means near its free end for removably attaching the sheet to the frame to prevent the sheet from accidentally rerolling upon the spring-loaded roller when the target sheet is hit by a pitched ball.

9. A pitcher's practice device comprising:

a. a base having two parallel tubular members connected at their midpoints by a modified T-connector to a cross member that is perpendicular to both so that the distance between the outside edges of the two parallel members substantially corresponds to the width of a baseball batter's strike zone;

b. an adjustable vertical frame rigidly attached to the modified T-connectors of the base, said vertical frame comprising a pair of parallel, tubular telescoping members attached at their lower end to the base, wherein each of said members has a lower vertical tube attached to the base, said tube having a series of holes that are evenly spaced along its length and an outside diameter slightly less than the inside diameter of a coaxial, upper vertical tube so that the upper tube slides over the lower one, wherein said upper tubes each contain a hole through which a bolt can be placed in order to lock the upper tubes at a specific height on the lower tubes;

c. a pair of bolts that are insertable through the holes in the telescoping members to lock the members at a specific height;

d. a horizontal, tubular cross member connected to the upper end of each telescoping member by elbow connectors so that the outside edges of the telescoping members are substantially the same distance apart as the width of a baseball batter's strike zone;

e. a spring-loaded roller mechanism mounted in a horizontal position on the frame flush with the top of it; and, f. a target sheet attached to the roller for simulating the strike zone, said sheet having a width equal to that of any batter's strike zone, said sheet also having one end fixedly attached to the roller so that a midsection of the sheet is rollable upon the roller and a second, free end of the sheet is adapted to hang from it, whereby the unrolled portion of the sheet between the top of the roller and the sheet's free end defines the length of the simulated strike zone, the free end defines the lower level of the device's strike zone and the length of the simulated zone can be selectively varied by rolling or unrolling the sheet from the roller to simultaneously adjust both the length of the device's strike zone and its lower level to conform to the actual length and lower level of the batter's strike zone.

* * * * *